US005464325A

United States Patent [19]

Albring et al.

[11] Patent Number: 5,464,325

[45] Date of Patent: Nov. 7, 1995

[54] TURBO-COMPRESSOR IMPELLER FOR COOLANT

[75] Inventors: Peter Albring, Dresden; Rainer Apley, Radebeul; Klaus Döge, Dresden; Günter Heinrich, Dresden; Ernst Lindner, Dresden; Norbert Müller, Dresden; Reinhard Pauer, Dresden; Eberhard Pilling, Dresden; Rainer Rudischer, Dresden, all of Germany

[73] Assignee: Institut fuer Luft- und Kaeltetechnik Gemeinnuetzige Gesellschaft mbH, Dresden, Germany

[21] Appl. No.: 266,940

[22] Filed: Jun. 27, 1994

[30] Foreign Application Priority Data

Jun. 25, 1993 [DE] Germany ..... 43 21 173.9

[51] Int. Cl.[6] ..... F01D 5/32

[52] U.S. Cl. ..... 416/185; 416/204 A; 416/214 A; 416/219 R; 416/220 R; 416/230

[58] Field of Search ..... 416/185, 204 R, 416/204 A, 214 R, 214 A, 219 R, 219 A, 220 R, 220 A, 230, 241 A; 415/198.1, 199.1, 200, 217.1

[56] References Cited

U.S. PATENT DOCUMENTS

| | | | |
|---|---|---|---|
| 1,041,511 | 10/1912 | Rice et al. | 416/204 R |
| 1,325,591 | 12/1919 | Stecker | 416/204 R |
| 3,670,382 | 6/1972 | Keehan | 416/230 |
| 3,700,355 | 10/1972 | Anderson et al. | 415/199.1 |
| 3,737,250 | 6/1973 | Pilpel et al. | 416/219 R |
| 5,165,856 | 11/1992 | Schilling et al. | 416/204 R |

FOREIGN PATENT DOCUMENTS 4139293 9/1993 Germany .

*Primary Examiner*—Edward K. Look
*Assistant Examiner*—Christopher Verdier
*Attorney, Agent, or Firm*—W. G. Fasse; W. F. Fasse

[57] ABSTRACT

A refrigerant or coolant compressor of the radial type with an impeller having a plurality of vane elements can be used for compressing water vapor as a refrigerant or coolant under vacuum conditions. The impeller of the compressor is constructed to produce a high volume flow rate at the required compression ratio, in view of the low density of water vapor as the preferred flow medium. The impeller has sufficient strength to operate at the required high circumferential velocities. The impeller includes vane elements, disk elements, vane support elements and a hub. The vane elements are individually connected to the hub by the support elements. The support elements may be either ring-shaped elements connecting a rear surface of the disk elements to the hub, or may be pin-shaped insert members connecting the root of each vane element to the hub. The components of the impeller are made of a polymer composite material reinforced preferably with carbon fibers.

6 Claims, 2 Drawing Sheets

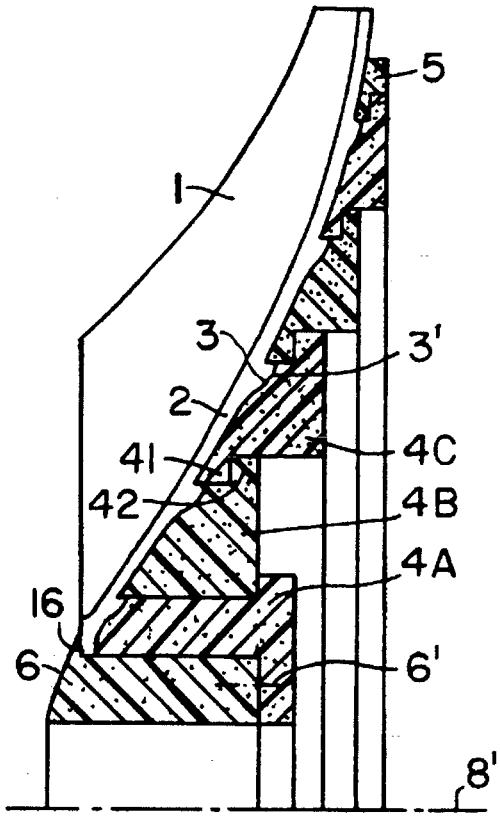
FIG.1
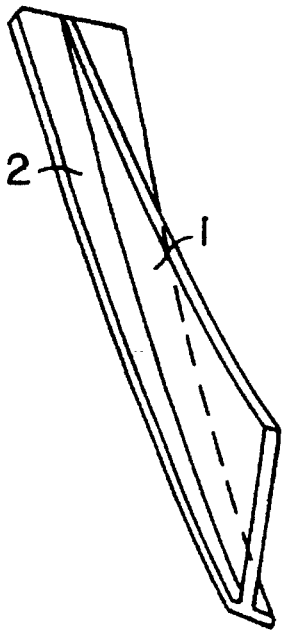
FIG.2
FIG.3
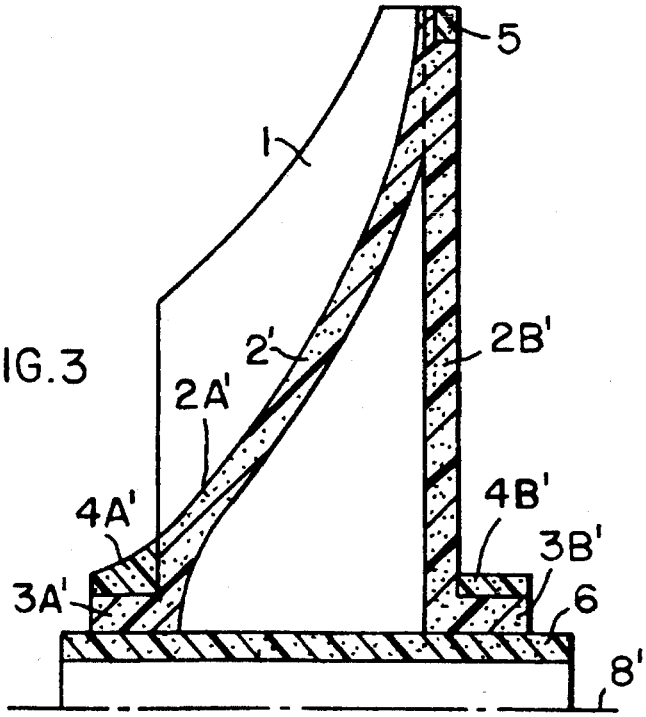

TURBO-COMPRESSOR IMPELLER FOR COOLANT

BACKGROUND OF THE INVENTION

1. Field of the Invention

The invention relates to a coolant or refrigerant turbo-compressor for compressing water vapor under vacuum conditions. The compressor has a plurality of impeller vanes and preferably is of a radial type.

2. Description of the Related Art

In order to protect the environment from the effects of some currently used coolants or refrigerants, it has become very important to develop and employ new refrigerants that are environmentally safe. In this context, water is a noteworthy alternative, but has previously not often been used as a coolant or refrigerant. The physical process of using water as a refrigerant or coolant has long been known. For example, as early as 1755, the Scotsman W. Cullen used a vacuum pump to vaporize water, thereby realizing a mechanical means of generating cooling or providing refrigeration.

For decades it has also been known to use water as a coolant or refrigerant in connection with absorption refrigeration plants and steam jet refrigeration plants. Similarly, it has long been known to use vapor compression apparatus in which water vapor is compressed and thereby raised to a higher energy level, for the purpose of generating heating steam, predominantly using turbo-compressors of a radial construction type. However, these machines are not economically applicable to refrigeration apparatus using water as a working medium, because the temperature ranges of the two different applications are substantially different. For example, the compressor intake or suction temperatures in vapor compression apparatus are in the range of approximately 80° to 120° C. On the other hand, refrigeration plants using water as a refrigerant require an intake temperature in a range between 0° and 50° C.

While such temperatures are also achieved in a steam jet refrigeration plant, the energy efficiency achieved is much lower than that of refrigeration plants using mechanical compression. The density of water vapor in refrigeration plants is up to 3 powers of ten less than the density involved in the vapor compression process or that involved in the compression of classical refrigerants. Due to the extremely low density of the water vapor, it is necessary to pump extremely large volume flows of the refrigerant through the refrigerating apparatus. Furthermore, it is necessary to provide compression ratios ($\pi$) of $\pi \approx 5$ in order to carry out the method.

While positive displacement compressors, such as known screw-type compressors for example, can develop the required compression ratio, such compressors are very limited in their maximum delivered volume flow and furthermore are considerably too expensive. On the other hand, single-stage kinetic or flow-type compressors, for example turbo-compressors of the radial type, cannot achieve the compression ratio required for use in a refrigeration apparatus. Furthermore, such compressors are quite expensive because they generally are designed for compressing gases or vapors having a considerably higher density, for example air, and therefore have been designed and constructed to be driven with a comparatively much higher specific drive power.

The vanes or blades of known radial compressor impellers are typically connected to a supporting rotor disk by welding or riveting, whereby the rivets are inserted through the vane or milled onto the vane. These known connecting methods cause problems, especially in compressors for compressing water vapor, wherein the impeller must have a large number of impeller vanes and each vane must be quite wide. In this case, it becomes increasingly difficult to attach the vanes to a supporting rotor disk in the typical manner, because the flow cross-sectional area remaining between the vanes becomes ever smaller or closed, the supporting disk becomes weakened, for example by rivet holes, or the grain structure is altered due to welding.

Highly mechanically loaded radial compressor impellets, i.e. so-called limit output impellers, are predominantly cast of steel or duralumin high strength aluminum alloy, forged and then machined by milling. Thus, the entire limit output impeller is a single integral piece. However, such one-piece cast, forged, and milled impellers are complicated and expensive to manufacture and suffer other disadvantages as well.

In order to achieve a smooth intake, it has been proved effective to bend the intake portion of the vanes in the circumferential direction or to use an intake impeller, which is predominantly a cast impeller. Such an intake impeller forms the intake portion or inlet zone of the impeller vanes. Such intake impellers have a relatively small diameter as compared to the outer diameter of the main impeller itself, and are therefore subjected to comparatively light mechanical loads. The attached or following radial vane, i.e. a radial fiber vane, is superior in material strength to all the other vanes. For this reason it is used in high compression ratio applications in which a high static pressure increase is required, in an apparatus having the smallest possible dimensions and without a particularly high efficiency. In such apparatus, circumferential velocities of up to 600 m/s are carried out.

It is already known to use fiber reinforced composite materials for the impellers of ventilators and for the vanes or blades of axial ventilators and ship's propellers. However, such embodiments using fiber reinforced composite material blades or vanes are only suitable for circumferential velocities up to a maximum of 100 m/s and are thus absolutely not suitable for limit output impellers.

Special turbo-compressors are required for compressing water vapor in the temperature and power range pertinent to refrigeration or cooling technology. Furthermore, such special turbo-compressors must be able to provide a high volume flow rate at a high compression ratio, while operating at a high energy efficiency. The price of such special turbo-compressors must be competitive when compared to typical prior art refrigerant compressors. Finally, it must be considered that very high centrifugal forces arise in radial-type turbo-compressors for high-power water vapor refrigeration apparatus due to the extraordinarily high circumferential velocities, in the range of 500 m/s for example. The centrifugal forces are the major load acting on the impeller, because the forces that must be applied or transmitted to the flow medium are comparatively small.

OBJECTS OF THE INVENTION

In view of the above it is the aim of the invention to achieve the following objects singly or in combination:

to provide a radial turbo-compressor having a particular impeller construction that achieves a high volume flow at the compression ratio necessary for compressing a low density flow medium, preferably water vapor, as a coolant or refrigerant;

to provide such a turbo-compressor having an impeller that can operate at the high circumferential velocities, for example in the range of about 500 m/s, necessary for compressing water vapor as a coolant or refrigerant, and having a sufficient strength to withstand all the applied forces, in particular the centrifugal forces;

to ensure a sturdy construction and good fluid flow characteristics in such a radial turbo-compressor even for specific applications that require the impeller to have a relatively great number of relatively wide vanes;

to provide an impeller for such a turbo-compressor, having a relatively simple construction that is cost economical and competitive to produce;

to produce an impeller for such a turbo-compressor by assembling and form-locking together several individual parts, including separate vane elements, a hub, and vane supporting elements, whereby the radially extending elements such as the vane elements are individually connected to the hub;

to assemble the impeller of such a turbo-compressor of individual vane elements and impeller disk elements without using a solid supporting rotor disk for carrying the vane elements, but instead assembling a plurality of vane elements and their associated impeller disk elements circumferentially next to one another; and to produce an impeller for such a turbo-compressor of composite material preferably reinforced with carbon fibers.

SUMMARY OF THE INVENTION

The above objects have been achieved in a refrigerant turbo-compressor of a radial type according to the invention, which is used to compress water vapor under vacuum conditions. The impeller of the compressor is assembled from a plurality of vane elements, impeller disk segments, vane supporting elements, and a hub. Individual ones, or all, of the separate elements are made of a polymer composite material, preferably reinforced with carbon fibers. The radially extending elements, such as the vane elements together with the impeller disk elements, are individually connected to the hub. Thereby, it is not necessary to provide a solid supporting rotor disk to which the vanes are attached as is practiced in the prior art. Instead, a rotor disk or impeller disk is formed by the individual impeller disk elements that are assembled together.

The impeller of the turbo-compressor according to the invention may further include an insert member in the root of each vane element to provide a friction-fitting and form-locking interconnection between each respective vane element and the hub. Preferably, the reinforcing fibers of the composite material of the vane elements wrap or extend around the insert members at the root of each vane element.

The vane supporting elements preferably include one or more rings that are arranged axially and/or radially spaced from one another. These rings form clamping rings that hold the vane elements and/or the impeller disk elements together in a friction-fitting and form-locking manner, especially against radially outwardly directed centrifugal forces.

A turbo-compressor according to the invention, having an impeller as described generally above, is able to meet all of the above discussed technical requirements. Because it is possible to achieve higher compression ratios with such a turbo-compressor, a single-stage or at most two-stage turbo-compressor of the radial type according to the invention is sufficient for all refrigeration applications with vaporization temperatures of at least 0° C. Because a simple one-stage or two-stage compressor is sufficient, and further in consideration of the light-weight construction, a compressor according to the invention may be manufactured considerably more cheaply than a typical compressor construction having impellers made of stainless steel or even titanium. As another result, additional savings are achieved in that the turbo-compressor may be directly driven at its shaft without using a costly and complicated drive transmission.

BRIEF DESCRIPTION OF THE DRAWINGS

In order that the invention may be clearly understood, it will now be described, by way of example, with reference to the accompanying drawings, wherein:

FIG. 1 is a partial axial section through an impeller of a turbo-compressor according to the invention;

FIG. 2 is a perspective view of a single vane element together with an impeller disk element, of the impeller shown in FIG. 1 for example;

FIG. 3 is a partial axial section through another embodiment of an impeller of a turbo-compressor according to the invention;

Figure 4:
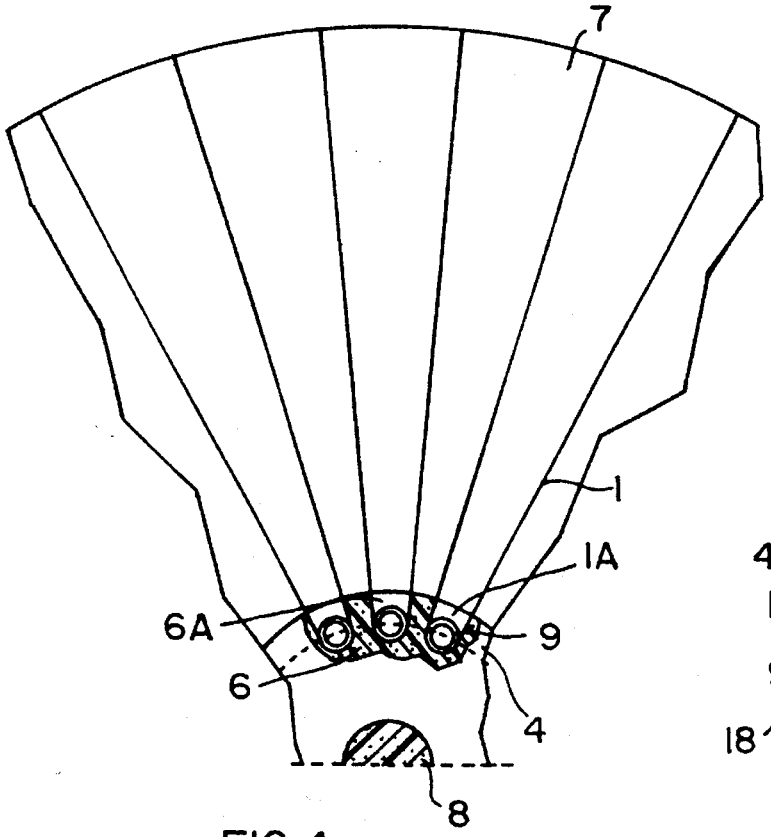
FIG. 4 is a partial axial end view of yet another embodiment of an impeller of a turbo-compressor according to the invention.

DETAILED DESCRIPTION OF PREFERRED EXAMPLE EMBODIMENTS AND OF THE BEST MODE OF THE INVENTION

The Figures show a half of an impeller above a rotation axis 8', of several embodiments of a turbo-compressor according to the invention. Generally, the impeller comprises individual vane elements 1 and disk segments or disk elements 2. Each vane element 1 and disk element 2 preferably form a single integral component. Each integral component including a vane element 1 and a disk element 2 is connected to a hub 6 as will be described in detail with reference to the individual Figures, so that circumferentially adjacent disk elements 2 form the impeller disk and the plurality of vane elements 1 form the vanes of the impeller. The embodiment of FIGS. 4 and 5 does not include a plurality of disk elements 2, but instead uses a single seal disk 7.

In the embodiment shown in FIG. 1, the vane elements 1 and the disk segments or elements 2 are connected to the hub 6 by support elements 4, referenced individually as 4A, 4B and 4C, for example. Each support element is a ring-shaped element extending completely in a circumferential direction to support and interlock all of the individual vane elements 1 and their associated disk elements 2. Nubs or projections 3 protrude from a back surface of each disk element 2. The projections 3 interlock with corresponding notches or grooves 3' provided on respective support elements 4.

To assemble the impeller shown in FIG. 1, the required number of vane elements 1 together with the associated disk elements 2 are placed in proper positions circumferentially adjacent one another against an outermost support element 5, which is a ring-shaped element. The disk elements 2 may be adjusted by properly adjusting the outermost support element 5. Successive radially inward ring-shaped support elements 4 are then placed against the back side of the disk elements 2, so that each successive support element 4 interlocks with each of the disk elements 2 by means of projections 3 and notches 3', as well as with the preceding radially outwardly adjacent support element 4 or 5. For example, support element 4C has a protruding rim 41 that is engaged in a form- and force-locking manner by protruding rim 42 of adjacent support element 4B.

Finally, an innermost support element 4A is arranged in a form- and force-locking manner between the preceding support element 4B and the hub 6. The disk element 2 and the support element 4A are axially supported against a protruding lip 16 of the hub 6. Thus, the innermost support element 4A is, in effect, a keystone element. The innermost support element 4A is connected to the hub 6 in a form- and force-locking manner, for example by an appropriate interlocking ridge and groove which is not shown in detail. Alternatively, the innermost support element 4A may be connected to the hub 6 by a screw, rivet or the like, as indicated generally with the reference numeral 6'. In this manner, each respective adjacent support element 4 is form- and force-locked to the next adjacent element 4, and all of the disk elements 2 are form- and force-locked to the support elements 4 by the projections 3 engaging recesses or grooves 3'. Especially the predominant centrifugal or radial forces, and also the axial forces, acting on the vane elements 1 and the disk elements 2 are transmitted through the projections 3 into the support elements 4 and 5 and thereby are further transmitted to the hub 6.

FIG. 2 is a perspective view of a vane element 1 and a disk segment or disk element 2. Preferably, the vane element 1 and disk element 2 are formed together as a single integral component, for example, of a fiber-reinforced composite material. Alternatively, the vane element 1 and the disk element 2 may be two separate elements that are interconnected to form the component shown in FIG. 2. The connection line or interface line between the vane element 1 and the disk element 2 may extend on a radial plane or may extend along a line that is slightly deflected in the circumferential direction from a radial plane as shown in FIG. 2.

Preferably, any or all of the separate components of the impeller according to the invention are made of a polymer composite material reinforced preferably with carbon fibers. The carbon fiber reinforcing material preferably extends substantially or predominantly radially in the vane elements 1 and the disk elements 2, that is to say the fibers extend in the direction of the lengthwise extension of the vane element 1 and the disk element 2, for example. On the other hand, the reinforcing carbon fibers in the support elements 4 and 5 preferably are oriented in a circumferential direction. The projections 3 of the disk elements 2 (see e.g. FIG. 1) also contain a reinforcing material such as carbon fibers embedded in a polymer matrix material.

FIG. 3 shows another embodiment of an impeller of a radial refrigerant compressor. In this embodiment, similarly as described above, a vane element 1 is connected to a disk element 2'. In this case however, the disk element 2' includes a forward disk element leg 2A' and a rear disk element leg 2B'. Preferably, the forward disk element leg 2A' and the rear disk element leg 2B' are formed together as one integral piece. Alternatively, the two disk element legs may be formed as separate pieces that are then joined together. The forward disk element leg 2A' includes a projecting rim or connecting foot 3A' and the rear disk element leg 2B' includes a projecting rim or connecting foot 3B'.

A plurality of vane elements 1 with their associated disk elements 2' are assembled circumferentially adjacent one another to form the impeller. The disk segments or disk elements 2 may also be constructed in such a manner that components thereof form a circumferentially continuous disk. A ring-shaped outer support element 5 holds the circumferentially outer edge of all of the vane elements 1 and disk elements 2', allows an adjustment of the vane elements 1 and disk elements 2' and then supports and holds in place the vane elements 1 and disk elements 2'. Further ring-shaped support elements 4A' and 4B' respectively encircle and engage the connecting foot 3A' of the disk element leg 2A' and the connecting foot 3B' of the disk element leg 2B', to support and mount all of the disk elements 2' onto the hub 6. As can be seen, the support elements 4A' and 4B' are arranged substantially axially spaced from one another while the support element 5 is arranged radially spaced from the support elements 4A' and 4B'. The connecting foot 3A' and connecting foot 3B' engage the hub 6 in a form- and force-locking manner, which is not shown in detail, but may include ridges or projections of the connecting feet 3A' and 3B' extending into corresponding fitting grooves of the hub 6. Thus, the support elements 4A', 4B' and 5 hold the vane elements 1 and disk elements 2' to the hub 6 with a friction fit and clamping effect.

As described above with reference to FIGS. 1 and 2, the individual components of the impeller shown in FIG. 3 are preferably made of a polymer composite material, reinforced preferably with carbon fibers. In the vane elements 1 and in the disk element legs 2A', the reinforcing fibers are preferably oriented substantially radially, or extending along the lengthwise direction of the component, to have a predominant radial orientation component but also an axial orientation component. On the other hand, the reinforcing fibers in the support elements 4A', 4B' and 5 are preferably oriented in a circumferential direction. Finally, the reinforcing fibers in the connecting foot 3A' and the connecting foot 3B' as well as in the rear disk element leg 2B' are preferably oriented radially as well as circumferentially, that is to say, some fibers or reinforcing strands extend radially while some fibers or reinforcing strands extend circumferentially.

Figure 5:
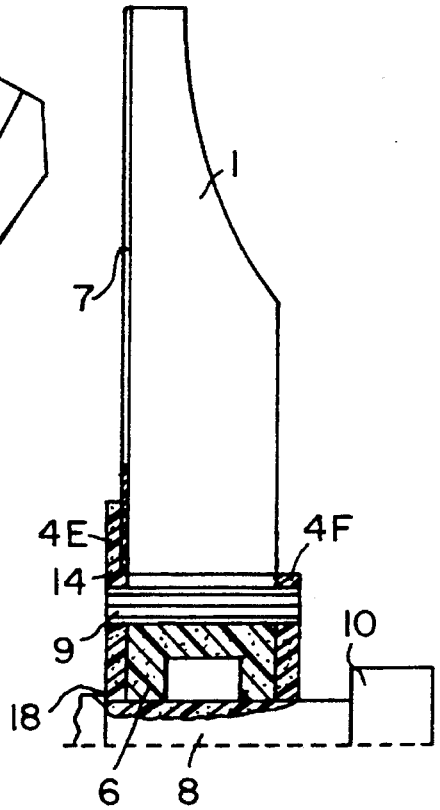
FIG. 5 is a partial axial section through the impeller shown in FIG. 4.

FIGS. 4 and 5 are a partial axial end view and a partial axial section of another embodiment of an impeller of a turbo-compressor according to the invention. In this embodiment, a plurality of vane elements 1 are individually connected to a hub 6, while a disk element 7 is preferably a single, circumferentially continuous disk element 7. The disk element 7 forms a so-called sealing disk, because it performs a fluid flow sealing function but does not perform a vane element supporting function as do the known supporting rotor disks.

As shown in FIGS. 4 and 5, the vane elements 1 are supported by the hub 6 and ring-shaped support elements 4E and 4F. In this context each vane element 1 is held in place by respective forward and rear support elements 4E and 4F, which respectively contact the forward and rear surfaces of hub 6. A respective insert member 9 extends through the root 1A of each vane element 1 and through corresponding holes in the support elements 4E and 4F. Each vane root 1A is received in an axially extending groove 6A in the hub 6. Each insert member 9 may, for example be a pin, a stud, a rivet, a split tube, or the like. The insert members 9 may be pushed through respective holes provided in the vane roots 1A. However, it is preferred that the insert members are embedded in the composite material of the vane roots 1A when the vane elements 1 are formed. Preferably, the reinforcing fibers of the composite material in the root 1A of the vane element 1 extend or wrap around the radially inner end of the root, i.e. to extend or wrap around the insert member 9.

The disk element 7 is a single disk with a hole in its center. The disk element 7 is seated against a radially extending portion of the rear support element 4E, with a shoulder rim 14 of the support element 4E engaging the hole in the disk element 7. Thus, to assemble the impeller, the rear support element 4E is pushed onto a shaft 8 until it supportingly rests against a shoulder rim 18 of shaft 8. Then disk element 7 is pushed with its hole onto rim 14 of support element 4E. Hub 6 is pushed onto shaft 8 against support element 4E. Vane elements 1 are inserted into grooves 6A of hub 6 with the insert members 9 extending into holes in support element 4E. Finally, support element 4F is pushed onto shaft 8 so that corresponding holes in support element 4F align with and engage the insert members 9. Thereby, the vane elements 1 are form-locked onto the hub 6 by the support elements 4E and 4F engaging ends of the insert members 9.

As shown particularly in FIG. 5, the shaft 8 may be directly driven by a drive 10 without an intermediate transmission. The drive 10 is shown generally schematically and may, for example, be a drive motor 10 with its output shaft coupled directly to the impeller shaft 8. The drive 10 may be connected to either end of the shaft 8. Another impeller according to any one of the above described embodiments may be mounted on shaft 8 in series with the impeller shown in the figures to form a two-stage compressor.

Although the invention has been described with reference to specific example embodiments, it will be appreciated that it is intended to cover all modifications and equivalents within the scope of the appended claims.

What is claimed is:

1. An impeller for a radial flow coolant turbo-compressor for compressing water vapor under vacuum conditions, comprising a plurality of vane elements, a disk element forming an impeller seal disk, a plurality of vane support elements and a hub, wherein said vane elements are arranged circumferentially next to one another and are supported and connected to said hub by said vane support elements, wherein said vane support elements comprise at least one support ring encircling said hub and a respective insert member connecting a root of each of said vane elements to said support ring, and wherein at least one member selected from the group consisting of said vane elements, said disk element, said support elements and said hub is made of a fiber-reinforced composite material.

2. The impeller of claim 1, wherein all components of said impeller are made of said fiber-reinforced composite material.

3. The impeller of claim 1, wherein said fiber-reinforced composite material is a polymer-based composite material having carbon fibers embedded therein.

4. The impeller of claim 1, comprising two of said support rings arranged at respective axial end surfaces of said root of each of said vane elements, wherein said insert members comprise pin-shaped members extending axially through and protruding axially from said root of each of said vane elements, and wherein each of said support rings has a plurality of holes that receive respective ones of said pin-shaped members to connect said vane elements to said hub.

5. The impeller of claim 4, wherein said root of each of said vane elements is made of fiber-reinforced composite material, wherein said pin-shaped members are embedded in the fiber-reinforced composite material of said root of each of said vane elements, and wherein reinforcing fibers of said composite material extend around said pin-shaped members.

6. The impeller of claim 4, wherein said hub has a plurality of axially extending grooves that receive said roots and said pin-shaped members.

* * * * *